United States Patent [19]

McHugh

[11] 4,193,888

[45] Mar. 18, 1980

[54] COLOR-YIELDING SCOURING CLEANSER COMPOSITIONS

[75] Inventor: Neil M. McHugh, Jersey City, N.J.

[73] Assignee: Colgate-Palmolive Company, New York, N.Y.

[21] Appl. No.: 937,006

[22] Filed: Aug. 25, 1978

Related U.S. Application Data

[63] Continuation of Ser. No. 426,286, Dec. 18, 1973, abandoned, which is a continuation of Ser. No. 177,158, Sep. 1, 1971, abandoned, which is a continuation of Ser. No. 816,092, Apr. 14, 1969, abandoned.

[51] Int. Cl.[2] ..... C11D 7/56

[52] U.S. Cl. ..... 252/99; 252/95; 252/187 H; 252/103; 252/116; 252/135; 8/108 R

[58] Field of Search ..... 252/95, 99, 187 H, 103, 252/116, 135; 8/108

[56] References Cited

U.S. PATENT DOCUMENTS

| | | | |
|---|---|---|---|
| 3,503,884 | 3/1970 | Chirash et al. | 252/95 |
| 3,544,473 | 12/1970 | Kitchen et al. | 252/99 |

FOREIGN PATENT DOCUMENTS

| | | | |
|---|---|---|---|
| 586019 | 10/1959 | Canada | 252/89 |

OTHER PUBLICATIONS

"Fast Pace Makes a Market" Chemical Week 73, (5), 8/1/1953, pp. 34–35.

*Primary Examiner*—Mayer Weinblatt
*Attorney, Agent, or Firm*—Norman Blumenkopf; Herbert S. Sylvester; Murray M. Grill

[57] ABSTRACT

Scouring cleanser compositions capable of yielding blue to green coloration on contact with aqueous media comprising (1) siliceous abrasive material (2) hypohalide-liberating bleaching agent (3) water soluble organic detergent and (4) a coloring agent comprising a pigmented carrier capable of undergoing color extension on contact with aqueous media.

17 Claims, No Drawings

COLOR-YIELDING SCOURING CLEANSER COMPOSITIONS

This application is a continuation of application Ser. No. 426,286, filed Dec. 18, 1973, now abandoned, which was a continuation of abandoned application Ser. No. 177,158, filed Sept. 1, 1971, which was a continuation of abandoned application Ser. No. 816,092 filed Apr. 14, 1969.

The present invention relates in general to cleansing compositions and in particular to the provision of scouring cleanser compositions capable of undergoing signal color change when contacted with aqueous media.

As is commonly recognized in the soaps, detergents and related industries, the physical appearance of a given cleanser composition is often of paramount importance as regards consumer acceptance, to the extent that, in certain instances, aesthetic rather than functional considerations are determinative of saleability. As is well known, certain colors predictably evoke a seemingly pre-conditioned "psychological" response on the part of the observer; thus, as regards cleansing compositions, the conditioned visual appeal of the public for whites, greens, blues, as well as color compositions resulting from their blends is for the most part incontrovertible. Irrespective of the many hypotheses thus far postulated in explanation of the foregoing, it nevertheless remains indisputably clear that the public tends to associate the aforementioned color aspects with the attainment or existence of a hygienic condition. In contradistinction, certain colors, e.g., the yellows, browns, etc. are somewhat repugnant to the sensitivity of the user in the particular environment of a cleansing composition.

In view of the foregoing, considerable industrial activity has centered around the research and development of cleansing formulae, such as typified by laundry detergents, scouring cleansers and the like, which would capitalize on the aforedescribed conditioned color response of the public. Although much in the way of meritorious achievement has characterized such efforts, the compositions evolved in connection therewith are nevertheless found to be subject to one or more significant disadvantages. Thus, many of the expedients heretofore promulgated involve as an essential feature the provision of the cleanser composition in colored or partly-colored form. However, perhaps the primary objection to compositions so fabricated relates to their off-white appearance in the dry state; otherwise stated, the predominant public preference for greens, blues, etc. ostensibly attaches to actual use of the compositions rather than its initial state, i.e., such color should most desirably be evident as a direct consequence of the employment of the composition in aqueous media and should not be an inherent attribute of the product per se. Thus, investigation makes manifestly clear than an optimum product is one substantially purely white in the dry state, yet capable of developing the desired color shade during use, e.g., when added to or otherwise contacted with aqueous media.

The remedial procedures heretofore recommended whereby to ameliorate the foregoing problems have provided but marginal advantage. Thus, the use of dyestuffs initially provided in the leuco form but responsive to some condition extant in the solution form of the cleanser composition, e.g., pH, temperature, etc., such "responsive" nature being physically manifested in the form of color change invariably proves somewhat unsatisfactory. Thus, the stability problems often encountered with the use of such colorants prove intolerable as a practical matter and particularly in those instances wherein oxidizing agents are present in the composition. Thus, the limitations imposed upon the use of such materials are, in many cases, so numerous as to dictate resort to the use of alternative procedures.

Cleansing compositions capable of developing distinct coloration whereby to color solutions containing same present a further and highly practical advantage, in that the user is afforded with visible means whereby to enable an estimate as to the concentration of composition present in the aqueous media; in a sense then, the involved color correlation provides metering means to expedite concentration adjustments. In addition, dissipation in the color strength and intensity of the cleanser solution during the course of use likewise provides visible means of estimating that point at which solution replenishment is required.

In accordance with the discovery forming the basis of the present invention, it has been ascertained that scouring cleanser compositions substantially pure-white in appearance and capable of undergoing a signal color change of striking contrast when contacted with aqueous media, may be formulated, provided certain critical requirements are observed in their manufacture.

Thus, a primary object of the present invention resides in the provision of scouring cleanser compositions wherein the foregoing and related disadvantages are eliminated or at least mitigated to a substantial extent.

Another object of the present invention resides in the provision of scouring cleanser compositions capable of undergoing signal color change on contact with aqueous media.

A further object of the present invention resides in the provision of scouring cleanser compositions specifically and advantageously adapted for use in connection with the cleansing treatment of hard surfaces.

Yet another object of the present invention resides in the provision of a process for the preparation of a scouring cleanser composition capable of undergoing signal color development in aqueous media.

Other objects and advantages of the present invention will become more apparent hereinafter as the description proceeds.

The attainment of the foregoing and related objects is made possible in accordance with the present invention which, in its broader aspects, includes the provision of a scouring cleanser composition containing as essential ingredients (1) a siliceous abrasive material, (2) a hypohalide-liberating bleaching agent, (3) a water soluble organic detergent and (4) a coloring agent capable of undergoing color extension when contacted with aqueous media.

The term "color extension" as used in the context of the present invention connotes the property of color formation or development in the sense of such color becoming visible to the unaided eye. The import of such term will be made abundantly clear by the discussion which follows:

The coloring agents contemplated for use in accordance with the present invention may be selected from a relatively wide range of materials, more specifically, one or more of the ingredients conventionally employed in the formulation of scouring cleanser compositions. In use, such materials would be provided in suitable pigmented form. Accordingly, the material selected for pigment-treatment may comprise: siliceous abrasive. e.g., silicon dioxide; detergent, whether anionic, cationic, nonionic, amphoteric, etc.; water soluble inorganic builder salts, suitable representatives thereof including trisodium phosphate, pentasodium tripolyphosphate, tetrapotassium pyrophosphate, tetrasodium pyrophosphate, alkali metal silicates, nitrates, chlorides, carbonates, borates, bicarbonates, etc., many of the aforementioned materials serving also as buffers, e.g., sodium bicarbonate, sodium metasilicate and the like; bleaching agent, e.g., chlorinated trisodium phosphate; however, it should be mentioned at this point that the use of N-chlorimide-type bleaching agents as coloring agents is not recommended due to stability problems; bleaching aids, e.g., alkali metal halides such as sodium bromide; antiseptic or germicidal agents; stain-removing agents such as carboxylic acids, including oxalic acid in particular. As will be seen from the foregoing, numerous variants are permitted whereby to fabricate a suitable coloring agent as the latter term is used in the context of the present invention. The coloring agents prescribed for use herein are uniformly characterized in that they are not visibly detectable or discernible in the scouring cleanser composition due to the convergence of several factors, e.g., non-color extendability of the colorant in the dry state, particle size, concentration employed in the total cleanser composition, etc.

It must be emphasized at this juncture that the particle size of the colorants contemplated for use in the practice of the present invention must conform to rather precise and stringent requirements, with departures therefrom vitiating any possibility of obtaining a product composition possessed of the desired whitish coloration, i.e., highly pure white in the dry state, while exhibiting marked color development or extension when contacted with aqueous media. Accordingly, the particle size of the colorant must be maintained within a range of 50 to 600 microns with a range of 200 to 400 found to be particularly beneficial. Otherwise stated, the particle size of the colorant should be such that about 95% passes though a 325 mesh screen. The importance of complying with the aforestated parameters can be made readily manifest by reference to the fact that any substantial deviation can be emasculatory. Thus, particle size substantially in excess of the maximum value stipulated would inevitably lead to a color-extended product composition, i.e., the latter would have a distinct, easily discernible tinge, e.g., blue, blue-green or analogous shade. Consequently, the desired white appearance would be unobtainable. Color extension in the dry state obtains in this instance due to the high population density of oversized particles. In contradistinction, the employment of exceedingly the particles, e.g., having a particle size substantially below the prescribed minimum value, unavoidably leads to color extension in the dry state due to the vast surface area presented by such particles. In any event, the requisite state of particle subdivision can be obtained according to conventional triturating means having reference to the nature of the particles, i.e., hardness, coarseness, frangibility, etc.

In order to avoid any possibility of dry state color extension, the proportions of coloring agent, i.e., pigmented carrier employed in the scouring cleanser composition must be confined within certain critical limitations, and more specifically, within the range of from about 0.001 to about 0.100 parts, and preferably 0.005 to 0.055 parts by weight of total composition.

In accordance with preferred practice, it is recommended, in preparing the colorant material, to premix the pigment selected for use with a matrix comprising the particles serving as the pigment carrier. The pigments contemplated for use in this connection, although encompassing a relatively broad class of materials, must nevertheless conform to predetermined requirements. Thus, it is critical, of course, that the pigment be "non-extended," the quoted term signifying as previously indicated, the tendency of such material to become visible in the parent composition. In general, pigments found to be useful herein comprise those which display substantial water-dispersibility. In contradistinction, those pigments categorized as non-water-dispersible form precipitates when added to aqueous media and accordingly would be unsuitable for use herein. Moreover, pigments of the latter type not only exhibit a pronounced and intolerable tendency towards color extension in dry scouring cleanser formulations but, in addition, form insoluble lakes or precipitates when added to aqueous media, such a condition being highly objectionable from an aesthetic standpoint. A further requirement imposed as regards pigment selection relates to color composition; thus, suitable pigments should possess a reflectance in the 450 to 535 millimicron wave length region of the visible spectrum such region comprising the locus of reflectances corresponding to blue through green. In addition, the pigment material must be one which is substantially stable in the presence of hypohalide-liberating bleaching agents, both in the wet and dry state, and particularly in view of the fact that the mixing and blending sequence employed in preparing the cleanser formula may be such as to require highly intimate contacting of pigment and bleaching agent.

Implicit in the foregoing is, of course, that the pigment material be devoid of any tendency to deleteriously affect the function contemplated for the parent composition. In any event, within the foregoing limitations, pigment selection may be exercised with respect to relatively broad classes of materials, with representatives of the latter including, without necessary limitation, animal pigments, mineral pigments and synthetic or artificial pigments. Particularly beneficial results are obtained with such materials as Phthalocyanine green and Phthalocyanine blue. It will be further understood that the pigment may be employed in admixtures comprising two or more, the advisability of so proceeding depending primarily upon the requirements of the processor.

In order to assure the obtention of optimum results, it is recommended, in pre-mixing the pigment and/carrier, to employ a weight ratio of carrier to pigment within the range of about 1:1 to about 150:1 with a range of 10:1 to 100:1 being particularly preferred. Again, compliance with the foregoing is necessary in order to minimize any possibility of color extension occurring in the dry state, and correspondingly, to insure that a color change of sufficient contrast occurs upon contacting the scouring cleanser with aqueous media. Within the ranges stated, it will be understood that the locus of optimum results will vary somewhat depending, for example, upon the nature and properties of both the pigment and carrier.

Without intending to be bound by any theory, it is postulated that pigment-carrier contacting results in adsorption or mere adherence of the pigment to the surface of the carrier, i.e., molecular diffusion characteristic of an absorption mechanism obtains, if at all, to only a negligible extent, In any event and regardless of the actual mechanism involved, it is found that the water-dispersible types of pigments adhere with requisite tenacity to the carrier particles thereby rendering handling, mixing etc. feasible.

The water-insoluble, inorganic siliceous abrasive materials contemplated for use in the present invention, may likewise be selected from a relatively wide range of materials, i.e., those substances conventionally employed in the preparation of hard surface-cleansing compositions. Again, certain criteria must be complied with in order to assure the provision of compositions of optimum efficacy. Thus, it is critically imperative that the siliceous abrasive be possessed of the necessary, substantially pure-white coloration. The terms "white", "whiteness," "substantially pure-white," etc. as used herein although subjective in nature can be reduced to objective significance; thus, it is mandatory that this particular component of the cleanser composition possess a light-reflectance value of at least 80–85% as measured at 550 mu. Reflectance measurements may be carried out employing apparatus well known in the art for such purposes, specific instruments including Photovolt Model 610 Filter Photometer, Gardner Model AC-1 Color Difference Meter, and the General Electric Recording Spectrophotometer. When carrying out reflectance evaluations utilizing the aforedescribed apparatus, the samples of siliceous material are provided in powder form. As will be understood, reflectance determinations are carried out according to standardized procedures, depending upon the apparatus employed. As a practical matter, it often becomes necessary in practice to augment the customary silica-whitening operation as by employing increased amounts of bleaching agent, e.g., zinc hydrosulfite, whereby to impart the necessary degree of whiteness to the siliceous abrasive material. The particle size of the siliceous abrasive employed should be maintained within a range of from about 0.001 mm to about 0.4 mm; ordinarily, the particle size of the abrasive material will be such that at least about 85%, and preferably 0.97% by weight thereof passes through a sieve having 0.74 mm openings. Moreover, particularly effective cleansing action may be assured by the employment of abrasive particles in the amount of at least 8% by weight said particles having a diameter of approximately 0.037 mm or larger. The abrasive material is employed in proportions of at least about 45% and preferably from about 45% to about 95% by weight of the cleanser, such concentration ranges found to be highly conducive to the attainment of the cleansing levels required in connection with the polishing of tarnished metal surfaces as well as the removal of smears or deposits of soft materials, such as aluminum, from porcelain surfaces. As a general rule, it is preferred that the siliceous material be high in alpha quartz content and free of even trace quantities of acid, since the latter can have deleterious effects on any perfume ingredient which might be included as optional addendum in the cleansing formula. Furthermore, it is of considerable importance that the moisture content of the siliceous material be less than about 0.1%, i.e., that such material be substantially anhydrous. As will be readily apparent, the presence of excess quantities of moisture in the dry state can be highly inimical due to the possibility of premature color extension. Siliceous abrasive materials of the requisite purity, coloration, etc. and found to be particularly suitable for use herein are commercially available from numerous sources, among which may be mentioned the silica material manufactured by the Penn Glass Sand Corp. under the trade name designation "Super White Treated 160," as well as the material "Extra Bright DF 90" available from the same source. Other examples of siliceous abrasives, eminently suitable for use herein include, in addition to silica (silicon dioxide), feldspar, pumice, volcanic ash, diatomaceous earth, bentonite, calcium carbonate talc, etc., as well as mixtures of the foregoing. Particularly beneficial results are found to obtain with the use of silica and feldspar, such substances being somewhat superior both from the standpoint of function as well as physical appearance, i.e., provide a whiter product.

As indicated previously, a portion of the siliceous abrasive may serve as the pigment carrier. That portion of the siliceous material diverted to pigment-carrier use must of course comply with the specifications previously delineated in connection with the discussion of suitable carriers having reference to proportions, particle size etc.

The scouring cleanser composition described herein further contain as an essential ingredient a bleaching agent which may be broadly defined as compounds capable of liberating hypochlorite chlorine and/or hypobromite bromine on contact with aqueous media. Such materials are, of course, well known in the art, being extensively described in the relevant literature. It is necessary, of course, that the bleaching agent be provided in anhydrous form in the sense of being devoid of free water; however, the presence of water of crystallization or hydration is permitted. Particular examples of bleaching agents include the dry, particulate heterocyclic N-bromo and N-chloro imides such as trichlorocyanuric, tribromocyanuric acid, dibromo- and dichlorocyanuric acid, and salts thereof with water-solubilizing cations such as potassium and sodium. Such bleaching agents may be employed in admixtures comprising two or more, a particularly efficacious bleaching agent in this regard comprising the material commercially available from the Monsanto Chemical Company under the trade name designation "ACL-66", ACL signifying "available chlorine" and the numerical designation "66", indicating the parts per pound of available chlorine. This particular product comprises a mixture of potassium dichloro-isocyanurate (4 parts) and trichloroisocyanuric acid (one part).

Other N-bromo and N-chloro imides may also be used, such as N-brominated and N-chlorinated succinimid, malonimid phthalimide and naphthalimide. Other compounds include the hydantoins, such as 1,3-dibromo and 1,3-dichloro-5,5-dimethylhydantoin; N-monochloro-C,C-dimethylhydantoin methylene-bis (N-bromo-C,C-dimethylhydantoin); 1,3-dibromo and 1,3-dichloro 5-isobutylhydantoin; 1,3-bromo and 1,3-dichloro 5-methyl-5-ethylhydantoin; 1,3-dibromo and 1,3-dichloro 5,5-diisobutylhydantoin; 1,3-dibromo and 1,3-dichloro 5-methyl-5-n-amylhydantoin, and the like. Other useful hypohalite-liberating agents comprise tribromomelamine and trichloromelamine. Dry, particulate, water soluble anhydrous inorganic salts are likewise suitable for use such as lithium hypochlorite and hypobromite. The hypohalite-liberating agent may, if desired, be provided in the form of a stable, solid complex or hydrate, such as sodium p-toluene-sulfo-bromamine-trihydrate, sodium benzene-sulfo-chloramine-dihydrate, calcium hypobromite tetrahydrate calcium hypochlorite tetrahydrate etc. Brominated and chlorinated trisodium phosphate formed by the reaction of the corresponding sodium hypohalite solution with trisodium phosphate (and water as necessary) likewise comprise efficacious materials. The present invention contemplates as an additional embodiment the use of bleaching agents capable of liberating hypochlorite as well as hypobromite such as, for example, the N-brominated, N'-chlorinated heterocyclic imides, as for example the N-bromo, N'chlorocyanuric acids and salts thereof, e.g., N-monobromo-N, N-dichlorocyanuric acid, N-monobromo-N-monochloro-cyanuric acid, N-monobromo-N-monochlorocyanuric acid, sodium-N-monobromo-N-monochlorocyanurate, potassium-N-monobromo-N-monochlorocyanurate; and the N-brominated, N-chlorinated hydantoins, e.g., N-bromo-N-chloro-5,5-dimethylhydantoin and N-bromo-N-chloro-5-ethyl-5-methyl hydantoin.

The hypohalide-liberating compound is employed in an amount of from 0.1 to 50% by weight of the composition, and preferably in an amount of from about 0.1 to 25% by weight thereof.

The detergent component of the compositions described herein comprise water soluble organic detergent materials which are stable in the presence of the contemplated hypohalite-liberating compound. There organic detergents may be of the anionic, cationic, amphoteric or non-ionic type provided of course that they are compatible with the compositions as a whole and in the proportions employed. In those instances, wherein the detergent is a liquid under normal conditions, as is the case with the non-ionic agents generally, they may be provided in particulate solid form after adsorption upon diatomaceous earth or other similar agents according to procedures well known in the art. Apart from the stability consideration; perhaps the salient requirement with respect to the detergent compound is that such material be of the requisite coloration, i.e.; substantially pure white, for the reasons more fully discussed hereinbefore e.g., physical appearance of the product, avoidance of dry state color extension, high contrast signal color change etc.

Thus, suitable anionic surface active agents include those surface active or detergent compounds which contain an organic hydrophobic group and an anionic solubilizing group. Typical examples of anionic solubilizing groups are sulfonate, sulfate, carboxylate, phosphonate and phosphate. Examples of suitable anionic detergents which fall within the scope of the invention include the soaps, such as the water-soluble salts of higher fatty acids or resin acids, such as may be derived from fats, oils, and waxes of animal, vegetable or marine origin, e.g., the sodium soaps of tallow, grease, coconut oil, tall oil and mixtures thereof; and the sulfated and sulfonated synthetic detergents, particularly those having about 8 to 26, and preferably about 12 to 22, carbon atoms to the molecule.

As examples of suitable synthetic anionic detergents there may be cited the higher alkyl mononuclear aromatic sulfonates such as the higher alkyl benzene sulfonates containing from 10 to 16 carbon atoms in the alkyl group in a straight or branched chain, e.g., the sodium salts of decyl, undecyl, dodecyl, (lauryl), tridecyl, tetradecyl, pentadecyl, or hexdecyl benzene sulfonate and the higher alkyl toluene, xylene and phenol sulfonates; alkyl naphthalene sulfonate, ammonium diamyl naphthalene sulfonate, and sodium dinonyl naphthalene sulfonate.

Other anionic detergents are the olefin sulfonates, including long chain alkeno sulfonates, long chain hydroxyalkane sulfonates or mixtures of alkenesulfonates and hydroxyalkenesulfonates. These olefin sulfonate detergents may be prepared, in known manner, by the reaction of $SO_3$ with long chain olefins, (of 8–25, preferably 12–21 carbon atoms) of the formula $RCH{=}CHR_1$, where R is alkyl and $R_1$ is alkyl or hydrogen, to produce a mixture of sultones and alkenesulfonic acids, which mixture is then treated to convert the sultones to sulfonates. Examples of other sulfate or sulfonate detergents are paraffin sulfonates, such as the reaction products of alpha olefins and bisulfites (e.g., sodium bisulfite), e.g., primary paraffin sulfonates of about 10–20, preferably about 15–20, carbon atoms; sulfates of higher alcohols; salts of $\alpha$-sulfofatty esters (e.g., of about 10 to 20 carbon atoms, such as methyl $\alpha$-sulfomyristate or $\alpha$-sulfotallowate).

Examples of sulfates of higher alcohols are sodium lauryl sulfate, sodium tallow alcohol sulfate. Turkey Red Oil or other sulfated oils, or sulfates of mono- or diglycerides of fatty acids (e.g. stearic monoglyceride monosulfate), alkyl poly (ethenoxy) ether sulfates such as the sulfates of the condensation products of ethylene oxide and lauryl alcohol (usually having 1 to 5 ethenoxy groups per molecule); lauryl or other higher alkyl glyceryl ether sulfonates; aromatic poly (ethenoxy) ether sulfates such as the sulfates of the condensation products of ethylene oxide and nonyl phenol (usually having 1 to 20 oxyethylene groups per molecule preferably 2–12).

The suitable anionic detergents include also the acyl sarcosinates (e.g. sodium lauroylsarcosinate) the acyl esters (e.g. oleic acid ester) of isothionates, and the acyl N-methyl taurides (e.g. potassium N-methyl lauroyl- or oleyl tauride).

The most highly preferred water soluble anionic detergent compounds are the ammonium and substituted ammonium (such as mono-, di- and triethanolamine), alkali metal (such as sodium and potassium) and alkaline earth metal (such as calcium and magnesium) salts of the higher alkyl benzene sulfonates, olefin sulfonates, the higher alkyl sulfates, and the higher fatty acid monoglyceride sulfates. The particular salt will be suitably selected depending upon the particular formulation and the proportions therein.

Nonionic surface active agents include those surface active or detergent compounds which contain an organic hydrophobic group and a hydrophilic group which is a reaction product of a solubilizing group such as carboxylate, hydroxyl, amido or amino with ethylene oxide or with the polyhydration product thereof, polyethylene glycol.

As examples of nonionic surface active agents which may be used there may be noted the condensation products of alkyl phenols with ethylene oxide, e.g., the reaction product of isooctyl phenol with about 6 to 30 ethylene oxide units; condensation products of alkyl thiophenols with 10 to 15 ethylene oxide units; condensation products of higher fatty alcohols such as tridecyl alcohol with ethylene oxide; ethylene oxide addends of monoesters of hexahydric alcohols and inner ethers thereof such as sorbitan monolaurate, sorbitol monooleate and mannitan monopalmitate, and the condensation products of polypropylene glycol with ethylene oxide.

Cationic surface active agents may also be employed. Such agents are those surface active detergent compounds which contain an organic hydrophobic group and a cationic solubilizing group. Typical cationic solubilizing groups are amine and as quaternary groups.

As examples of suitable synthetic cationic detergents there may be noted the diamines such as those of the type $RNHC_2H_4NH_2$ wherein R is an alkyl group of about 12 to 22 carbon atoms such as N-2-aminoethyl stearyl amine and N-2-aminoethyl myristyl amine; amido-linked amines such as those of the type $R^1CONHC_2H_4NH_2$ wherein R is an alkyl group of about 9 to 20 carbon atoms, such as N-2-amino ethyl-stearyl amide and N-amino ethyl myristyl amide; quaternary ammonium compounds wherein typically one of the groups linked to the nitrogen atom are alkyl groups which contain 1 to 3 carbon atoms, including such 1 to 3 carbon alkyl groups bearing inert substituents, such as phenyl groups, and there is present as anion such as halogen, acetate, methosulfate, etc. Typical quaternary ammonium detergents are ethyl-dimethyl-stearyl ammonium chloride, benzyl-dimethyl-stearyl ammonium chloride, benzyl-dimethyl-stearyl ammonium chloride, trimethyl stearyl ammonium chloride, trimethyl-cetyl ammonium bromide, dimethyl-ethyl dilauryl ammonium chloride, dimethyl-propyl-myristyl ammonium chloride, and the corresponding methosulfates and acetates.

Examples of specific amphoteric detergents are N-alkyl-beta-aminopropionic acid; N-alkyl-beta-iminodipropionic acid, and N-alkyl, N,N-dimethyl glycine; the alkyl group may be, for example, that derived from coco fatty alcohol, lauryl alcohol, myristyl alcohol (or a lauryl-myristyl mixture), hydrogenated tallow alcohol, cetyl, stearyl, or blends of such alcohols. The substituted aminopropionic and iminodipropionic acids are often supplied in the sodium or other salt forms, which may likewise be used in the practice of this invention. Examples of other amphoteric detergents are the fatty imidazolines such as those made by reacting a long chain fatty acid (e.g. of 10 to 20 carbon atoms) with diethylene triamine and monohalocarboxylic acids having 2 to 6 carbon atoms, e.g. 1-coco-5-hydroxyethyl-5-carboxymethylimidazoline; betaines containing a sulfonic group instead of the carboxylic group; betaines in which the long chain substituent is joined to the carboxylic group without an intervening nitrogen atom, e.g. inner salts of 2-trimethylamino fatty acids such as 2-trimethylaminolauric acid, and compounds of any of the previously mentioned types but in which the nitrogen atom is replaced by phosphorous.

The detergent material is employed in concentrations ranging from about 0.5 to about 30 parts by weight of total composition with a range of 1 to 7 parts being particularly preferred.

Various other materials may be included in the compositions described herein; thus, water soluble builder salts comprise particularly preferred addenda; included in this group are the inorganic and organic; basic and neutral water soluble salts. The builder salt is employed in amounts ranging up to about 95% i.e., 0–95% by weight with a range of from about 3 to about 30% by weight of the composition being preferred. Suitable builders include without necessary limitation, Trisodium phosphate
Tetrasodium pyrophosphate
Sodium acid pyrophosphate
Sodium tripolyphosphate
Sodium monobasic phosphate
Sodium dibasic phosphate
Sodium hexameta phosphate
Sodium silicates, $SiO_2/Na_2O$ of 1/1 to 3.2/1
Sodium carbonate
Sodium sulfate
Borax etc.

Other organic builders include salts of organic acids and, in particular, the water soluble salts of aminopolycarboxylic acids. The alkali metal salts such as sodium, potassium and lithium; ammonium and substituted ammonium salts such as methylammonium, diethanolammonium and triethanolammonium; and amine salts such as mono, di- and triethanolamine methylamine, octylamine diethylenetriamine, triethylenetetramine and ethylenediamine are efficacious. The acid portion of the salt can be derived from acids such as nitrilodiacetic; N-(2-hydroxyethyl) nitrilodiacetic acid, nitrilotriacetic acid (NTA), ethylenediamine tetracetic acid, (EDTA); N-(2-hydroxyethyl) ethylene diamine triacetic acid; 2-hydroxyethyl iminodiacetic acid; 1,2-diaminocyclohexanediacetic acid; diethylenetriamine penta-acetic acid and the like. The builder salt is preferably employed in amounts sufficient to yield a pH in water of from 8.5 to 13 and preferably from 9.5 to 11.5.

It will be understood that the aforementioned builder salt and detergent ingredients may serve, in part, as the carrier for the pigment materials and in such capacity serve as the colorant. When so proceeding, it is only necessary that the previous desiderata enumerated in connection with the discussion of colorant requirements be complied with.

One of the particularly advantageous embodiments of the present invention concerns the use of a bleaching aid as a complementary ingredient to the hypochlorite and/or hypobromite bleaching agents defined hereinbefore. Water-soluble inorganic halide salts such as sodium bromide prove particularly effective for such use. The sodium bromide functions to supplement the bleaching activity of the hypohalite-liberating agent according to a mechanism which can perhaps best be characterized as analogous to a "triggering" action, i.e., the bleaching aid triggers release of hypochlorite ion and/or hypobromite ion. Compositions so constituted, i.e., containing both bleaching agent and bleaching aid are commonly referred to as "double bleach" formulations. Compositions of this nature characteristically provide synergistically enhanced bleaching rates and to this extent are particularly preferred modes of proceeding. The sodium bromide proves especially effective as a carrier material for the pigment; thus, in addition to being a highly functional ingredient in the sense of contributing to and enhancing the target utility of the parent composition, the bromide component likewise provides exceptional means by which to introduce the pigment material into the cleansing formula. The substantially instantaneous color change which accompanies the addition of the scouring cleanser formula to aqueous media would, where pigmented sodium bromide comprises the colorant, indicate evolution or generation of bleaching species within the aqueous solution.

Among the other ingredients which may be employed in formulating the compositions described herein there may be mentioned antiseptic agents, germicides, perfumes and the like. Materials of this nature would be employed in minor amounts, with concentration ranges of from 0.05 to 3% by weight of total composition being found eminently suitable. Preferred perfuming agents include those of the terpineol type which possess a pine-like fragrance; other representatives include the lemon-scented perfumes commonly referred to as "citronella," as well as "limonene," the latter likewise having a citrus-like fragrance. The terpineol-type perfumes have definite functional utility since materials of this type i.e., derived from terpenes, act to effectively stabilize the hypohalite-liberating bleaching agent, and particularly trichloroisocyanuric acid, dichloroisocyanuric acid and their salified derivatives by suppressing or otherwise retarding any tendency of the bleaching agent to lose halogen. Optional ingredients of the aforementioned type where provided in solid form may likewise be employed as carriers for the pigment; again, if so employed, such ingredient would necessarily require provision in suitable form as regards particle size, concentration, and the like.

In preparing the scouring cleanser compositions of the present invention, it is recommended for optimum results that mixing and blending be carried out according to a prescribed chronology of operations. In certain instances, such as where perfume is added, it is absolutely mandatory that the prescribed mixing sequence be observed. Mixing may be carried out in any suitable apparatus equipped with agitator means such as, for example, a ribbon mixer agitator. Thus, in practice, approximately 40 to 60% of the siliceous abrasive material is charged to the mixer agitator followed by, in order, perfume (optional), colorant, detergent, builder salt, bleaching agent and the balance of the siliceous abrasive. It is suggested that, upon completing the addition of a given ingredient, a definite period of time be allowed to lapse, whereby to insure homogeneous and uniform distribution of such ingredient throughout the composition. In addition, it should be emphasized that considerable care should be exercised when adding perfume in order to insure uniform distribution or spreading of the perfume over the entire surface of the mix. This can be best achieved by introducing the perfume in the form of a spray. Otherwise, the perfume may tend to agglomerate thereby leading to perfume-bleach interreaction with the concomitant evolution of highly toxic gaseous substances, e.g., nitrogen trichloride, chlorine and bromine gases etc.

After all ingredients are added, the composition is transferred to a magnetic separator for purposes of removing metallic contaminants which may be present in the recipe. Thus, in some cases, it is found that metallic impurities are entrained along with those ingredients which have been previously subjected to size-reduction. The composition is thereafter transferred to a suitable mill, e.g., a centrifugal impact grinder, whereby to adjust the final particle size of the composition. Upon completion of the milling operation, the securing cleanser is ready for packaging in the usual manner.

The following examples are given for purposes of illustration only and are not to be considered as necessarily constituting a limitation on the present invention. All parts and percentages given are by weight, unless otherwise indicated.

EXAMPLE 1

The following composition is prepared:

| Ingredient | % |
|---|---|
| Finely ground silicon dioxide* | 88.497 |
| Pefume | 0.250 |
| Preblend of blue Phthalocyanine pigment and sodium bromide (colorant) | 0.718 |
| Sodium dodecylbenzene sulfonate | 6.085 |
| Trisodium phosphate | 3.950 |
| Trichloroisocyanuric acid | 0.500 |
| | 100.000 |

*particle size: (average) 8.5 microns

The preceding composition is substantially pure-white in appearance having a reflectance of approximately 88% as measured on a Gardner AC-1 Color Difference Meter. Moreover, despite careful visual examination of the dry cleanser, nothing in the way of colored dots, speckles, or even the slightest trace of color tinge is evident. Upon dissolution in aqueous media, the composition yields a brilliant blue solution, the highly contrasting color change involved occurring substantially simultaneously with cleanser addition. The composition proves highly effective for use in connection with the cleansing of various types of stains e.g., grease, soil etc. from hard surfaces such as ceramic tile, porcelain, metal and the like. The preblend of blue phthalocyanine pigment employed in the above example and sodium bromide is prepared by admixing 2.6 parts of the pigment with 97.4 parts of white sodium bromide obtained from the Great Lakes Chemical Co. This material had a particle size of 10–150 microns (average).

The composition was prepared according to the following blending sequence employing a scale mixer agitator which was continuously maintained at a speed of 37.5 RPM throughout the entire mixing cycle.

1. Start ribbon mixer agitator
2. Add portion (approximately 40–60%) of total siliceous abrasive to be employed.
3. Spray in perfume-avoid formation of agglomerates by uniformly distributing perfume over entire surface of mix; allow mixing to continue for about 3 minutes after completion of perfume addition.
4. Add blue-pigmented sodium bromide-distribute evenly over entire mix surface; allow mixing to continue for about 1 minute
5. Add total amount of detergent and allow to mix thoroughly.
6. Add total amount of trisodium phosphate and allow to mix thoroughly.
7. Add total amount of bleach (TCCA).
8. Add balance of formula amount of siliceous abrasive.
9. Transfer composition to magnetic separator.
10. Transfer composition to centrifugal impact grinder: particle size of product composition:

EXAMPLE 2

Example 1 is repeated except that the colorant employed comprises a pre-blend of Phthalocyanine green (2.5 parts) green and sodium bromide (97.5 parts). Similar results are obtained i.e., a striking color change to a brilliant green is obtained upon addition of the composition to aqueous media. Moreover, the composition exhibits superior bleaching action in the treatment of various types of hard surfaces.

EXAMPLE 3

In this example, the TCCA of Example 1 is replaced with chlorinated trisodium phosphate. The formulation, prepared according to the procedure described in Example 1 has the following composition:

| Ingredient | % |
|---|---|
| Finely ground silicon dioxide | 85.798 |
| Perfume | 0.250 |
| Preblend of blue Phthalocyanine pigment and sodium bromide | 0.512 |
| Sodium alkylbenzene sulfonate | 3.940 |
| Sodium bicarbonate | 2.000 |
| Chlorinated Trisodium phosphate | 7.500 |
| | 100.000 |

EXAMPLE 4

Example 3 is repeated except that colorant employed comprises the Phthalocyanine green-sodium bromide pre-blend of Example 2. Results similar to those described in the foregoing examples in terms of signal color change upon dissolution in aqueous media, bleaching efficacy etc. are obtained.

EXAMPLES 5-18

Example 1 is repeated except for the modifications specified; the results obtained are summarized in the table which follows:

| Ex. No. | Bleaching agent | Colorant carrier | Colorant pigment | wgt ratio carrier/pigment |
|---|---|---|---|---|
| 5 | Trichloroisocyanuric acid | silica | phthalocyanine blue | 50/1 |
| 6 | Tribromoisocyanuric acid | NaBr | phthalocyanine blue | 25/1 |
| 7 | dichloroisocyanuric acid | silica | Phthalocyanine green | 50/1 |
| 8 | dibromoisocyanuric acid | NaBr | Phthalocyanine green | 25/1 |
| 9 | dichloroisocyanuric acid sodium salt | Trisodium phosphate | Phthalocyanine green | 75/1 50/1 |
| 10 | dibromoisocyanuric acid potassium salt | sodium bicarbonate | Phthalocyanine green | |
| 11 | calcium hypochlorite | sodium dodecyl benzene sulfonate | Phthalocyanine green | 25/1 |
| 12 | lithium hypobromite | silica | Phthalocyanine green | 50/1 |
| 13 | dichloroisocyanuric acid, potassium salt (4 parts) and trichloroisocyanuric acid. (1 part) | NaBr | Phthalocyanine green | 25/1 |
| 14 | potassium monobromo monochloro cyanurate | NaBr and silica (1:1 wgt. ratio) | phthalocyanine blue | 50/1 |
| 15 | N-bromo-succinimide | sodium silicate | phthalocyanine blue | 75/1 |
| 16 | N-chloro-succinimide | sodium sulfate | phthalocyanine blue | 75/1 |
| 17 | Trichloroisocyanuric acid | feldspar | phthalocyanine blue | 50/1 |
| 18 | N-monobromo-N-monochloro-5, 5-dimethylhydantoin | NaBr | phthalocyanine blue | 25/1 |

Each of the preceding compositions produced a striking color change on addition to aqueous media. In all cases, the compositions exhibit a pleasingly white color, there being no evidence of an off-white tinge or dry state color extension. The particle size of each of the carrier materials is within the range of 1 to 1500 microns, while the particle size of the product composition, after treatment in the centrifugal impact grinder, is within the range of 1 to 500 microns in each instance.

The moisture content of each of the exemplified compositions is adjusted to a value of less than 0.4% by weight of total composition. As indicated previously, it is preferred that the moisture content of each of the ingredients employed be confined to minimal values i.e., anhydrous, in order to eliminate even the slightest possibility of dry state color extension occurring to an appreciable extent. Although provided in a substantially dry state, i.e., in in the sense of being substantially devoid of free water, such compounds may contain water of crystallization or hydration i.e., water in firmly bound form. Thus, the moisture content limitations stipulated herein apply to "free" water content. Thus, most of the commercially available siliceous material, this particular ingredient being the predominant one in terms of concentration employed, have moisture contents of less than about 0.1%.

Results similar to those described in the foregoing examples are obtained when the procedures set forth therein are repeated but wherein detergents of the non-ionic, cationic and amphoteric types are employed. The non-ionics prove particularly effective in those applications wherein lower foam levels are desired. Cationic detergents, on the other hand, may be employed where bacteriostatic activity is desired since detergents falling within this category often possess a pronounced capacity to destroy germs.

In some instances it may be considered desirable to employ the pigment per se as the coloring agent thereby obviating any necessity for employing a separate carrier component. In general, however, the use of a carrier comprises preferred practice since such a procedure enables the expeditious achievement of the requisite dispersion of coloring agent throughout the cleanser composition. In any event, the terms "coloring agent", "pigmented carrier", etc. as used in the context of the present invention is to be accorded a significance consistent with the use of either embodiment.

What is claimed is:

1. A substantially white scouring cleanser composition capable of undergoing signal color change on contact with aqueous media consisting essentially of, on a weight basis, (1) from 45 to 95% of a substantially anhydrous water insoluble abrasive material having a particle size within the range of from about 0.001 mm to about 0.4 mm and at least about 85% thereof passes through a seive having 0.074 mm openings, selected from the group consisting of silica, fedspar, pumic volcanic ash, diatomaceous earth, bentonite, calcium carbonate and talc, and mixtures thereof, (2) from 0.1 to 50% of a bleaching agent capable of liberating hypohalide on contact with aqueous media, (3) from 0.5 to 30% of a water-soluble organic detergent stable in the presence of said bleaching agent, and (4) from 0.1 to 10.0% by weight of a coloring agent which is a pigmented carrier capable of undergoing color extension on contact with aqueous media, the pigment being substantially water dispersable selected from the group consisting of water dispersible animal, mineral and synthetic pigments, the particle size of said pigmented carrier being within the range of 50 to 600 microns with 95% passing through a 325 mesh screen, being substantially stable in the presence of said bleaching agent said pigment having a reflectance in the 450 to 535 mm wavelength region of the visible spectrum, the weight ratio of carrier to pigment being from about 1:1 to about 150:1 and wherein said carrier is selected from the group consisting of the abrasive materials defined in (1), water soluble organic detergent, water soluble builder salt, sodium bromide and sodium sulfate.

2. A composition according to claim 1 wherein said carrier is sodium sulfate.

3. A composition according to claim 1 wherein said carrier is silica.

4. A composition according to claim 1 wherein said carrier is trisodium phosphate.

5. A composition according to claim 1 wherein said carrier is sodium bicarbonate.

6. A composition according to claim 1 wherein said carrier is sodium dodecyl benzene sulfonate.

7. A composition according to claim 1 wherein said carrier is a mixture of sodium bromide and silica.

8. A composition according to claim 1 wherein said carrier is sodium sulfate.

9. A composition according to claim 1 wherein said carrier is feldspar.

10. A composition according to claim 1 wherein said organic detergent is sodium dodecyl benzene sulfonate.

11. A composition according to claim 10 further containing a small amount of perfume.

12. A composition according to claim 11 wherein said siliceous abrasive is silica, said bleaching agent is trichloroisocyanuric acid, said organic detergent is sodium dodecyl benzene sulfonate, said colorant is phthalocyanine-pigmented sodium bromide and said builder salt is trisodium phosphate.

13. A composition according to claim 11 wherein said abrasive is silica, said bleaching agent is chlorinated trisodium phosphate, said organic detergent is sodium dodecyl benzene sulfonate, said colorant is phthalocyanine-pigmented sodium bromide and said builder salt is sodium bicarbonate.

14. A composition according to claim 1 wherein said carrier is sodium bromide.

15. A composition according to claim 14 wherein said bleaching agent is selected from the group consisting of N-chlorimides, N-bromimides and N-brom, N-chlorimides.

16. A composition according to claim 15 wherein said bleaching agent is selected from the group consisting of trichloroisocyanuric acid, tribromoisocyanuric acid, dichloroisocyanuric acid, dibromoisocyanuric acid, and the alkali metal salts thereof.

17. A composition according to claim 16 wherein the abrasive is silica, the carrier is sodium bromide and the pigment is a phthalocyanine.

* * * * *